US007281679B1

(12) United States Patent
Jones

(10) Patent No.: US 7,281,679 B1
(45) Date of Patent: Oct. 16, 2007

(54) REPLACEABLE REEL STAVE COVER AND METHODS OF MAKING THE SAME

(76) Inventor: Douglas Kevin Jones, 1490 Frisbee Rd., Cabool, MO (US) 65689

( * ) Notice: Subject to any disclaimer, the term of this patent is extended or adjusted under 35 U.S.C. 154(b) by 22 days.

(21) Appl. No.: 11/446,623

(22) Filed: Jun. 5, 2006

(51) Int. Cl.
*B65H 75/18* (2006.01)

(52) U.S. Cl. ..... 242/609; 242/613.4

(58) Field of Classification Search ..... 242/609, 242/609.1, 609.2, 609.4, 607, 610, 610.4, 242/610.6, 613, 613.4, 601, 604, 118.1, 129.6
See application file for complete search history.

(56) References Cited

U.S. PATENT DOCUMENTS 994,025 A * 5/1911 Montgomery
1,701,131 A * 2/1929 Stuhlmann
1,822,474 A * 9/1931 Bureau
2,278,380 A * 3/1942 Malkomes et al.
4,345,724 A 8/1982 Lindell
5,246,184 A 9/1993 Trewhella
5,954,294 A * 9/1999 Forsner
6,460,796 B1 10/2002 Berning et al.
6,651,926 B1 11/2003 Alexander
2002/0185565 A1* 12/2002 Wilson

* cited by examiner

*Primary Examiner*—William A Rivera
(74) *Attorney, Agent, or Firm*—Richard L. Marsh

(57) ABSTRACT

A material carrying reel comprises a pair of spaced apart side flanges and a plurality of staves affixed to the side flanges where the plurality of staves comprise a core of the material carrying reel. Each stave has a cover thereupon which comprises an elongated channel having a flexible extension extending from at least one edge of a closed side of the channel, the flexible extension providing support to material wound upon the material carrying reel.

20 Claims, 3 Drawing Sheets

REPLACEABLE REEL STAVE COVER AND METHODS OF MAKING THE SAME

BACKGROUND OF THE INVENTION

1. Field of the Invention

This invention relates to a replaceable cover for a stave of a material storage and handling reel and for a material storage and handling reel employing a replaceable stave.

2. Prior Art Statement

It is known to provide a storage and handling reel for wire, rope, flexible tubing or fiber optic cable that has wooden flanges spaced apart by a plurality of curved or straight wood boards held in grooves in the flanges by through bolts, the boards substantially comprising a core of the reel. For instance, see the photograph of a standard wooden reel.

It is also known to provide three curved core segments for a conventional reel wherein the three curved segments fit into the groove of the standard wooden flanges. It is intended to dispose of the flanges will likely be thrown away but that the plastic core segments are to be returned to the winding facility for construction of another reel. For instance, see the U.S. Pat. No. 5,246,184 issued on Sep. 21, 1993 to Stephen W. Trewhella.

It is further known to provide a hub that is covered with materials such rubber, plastic, wood, carpet or fabric or may consist of a plurality of separate plates individually supported on a smaller central hub. In another embodiment, the hub may include a biasing member to exert a radially outward force on the spooled tubing. For instance, see U.S. Pat. No. 6,460,796 B1 issued on Oct. 8, 2002 to Berning, et al.

Finally, it is known to provide staves on a reel that are rigidly affixed to one of the flange assemblies, preferably every other spoke of the flange, while a corresponding flange has a receiving socket with a keeper. The staves are made of tubing and the assembled cage of staves is covered with a flexible sheet material of fiberboard, metal or plastic to protect from kinking or bending of the electrical cable when wound on the reel. The reel is a "lightweight reel" which can be readily disassembled, several nested together and shipped in the nested condition. Another reel which is capable of being disassembled and shipped has the staves bolted to central hub plates in slots adjacent the spokes. There are two slots in each hub plate which allows two staves in close spaced relationship at each spoke. For instance, see U.S. Pat. No. 4,345,724 or 6,651,926 B1 issued on Aug. 24, 1982, Nov. 25, 2003 to Willard G. Lindell and William J. Alexander, respectively.

SUMMARY OF THE INVENTION

Early prior art material storage and handling reels made of wood are still in use but are heavy, expensive and prone to damage during use. Though wood reels provide support to material wound on the reel, the wood is rigid thus causing some kinking of the material at the ends of the wood surface. Additionally, wood reels and wood stave covers are generally discarded in the field. Newer prior art reels are lighter in weight, made of steel and usually may be disassembled for return to the winding facility. Product wound on these steel reels is often damaged because the product is kinked around the relatively narrow staves, and although a greater number of staves could be added to the reel, each stave requires a spoke on both flanges for support contributing significant weight to the reel, thus defeating the purpose of light weight. One hybrid prior art reel has six inch wide, two inch thick wood stave covers bolted to the steel staves which imparts some support to the material wound on the reel, however, the wood contributes added weight, is prone to breakage or loss, oftentimes kinks the material at the end of the wood stave cover and requires additional disassembly time in the field in order to discard the wood stave and return the reel. Since the prior art reels have some significant drawbacks, an improved material handling reel is needed which provides gentler support to the product wound on the reel without imparting substantial weight to the reel. Therefore, it is a primary object of this invention is to provide a material carrying reel comprising a pair of spaced apart side flanges and a plurality of staves affixed to the side flanges, the plurality of staves comprising a core of the material carrying reel, the improvement wherein at least one the stave has a light weight cover thereupon, the cover comprising an elongated channel having a flexible extension extending from at least one edge of a closed side of the channel, the flexible extension providing support to material wound upon the material carrying reel.

One feature of this invention is to provide a material carrying reel comprising a pair of spaced apart side flanges, a plurality of staves and at least one stave cover wherein the stave cover comprises an elongated channel having a flexible extension extending from at least one edge of a closed side of the channel wherein the flexible extension extends from both side edges of the closed side of the channel One goal of this invention is to provide a stave cover for a stave of a material handling reel that is formed from a material selected from the group consisting polymeric material, wood, wood byproducts, light weight metal, ivory, or combinations thereof.

One purpose of this invention is to provide a stave cover formed by extrusion, injection molding, transfer molding, compression molding, machined from bar stock or combinations thereof.

Another primary goal of this invention is to provide a stave cover formed from a polymeric material selected from the group consisting epoxy, acrylic, vinyl ester, methyl methacrylate, isophthalic polyester, terephthalic polyester, orthophthalic polyester, dicyclopentadiene, polyurethane, acetals, vinyls, tetrafluoroethylenes, propylenes, ethylenes, styrenes, amides, amide-imides, parabenzamides, vinylchlorides, carbonates, ABS, acrylates, polycarbonate, polypropylene, polyethylene, polyvinyl chloride, vinyl, polyamide, polyparabenzamide, fiberglass, polystyrene, epoxy, acrylic, vinyl ester, methylmethacrylate, isophthalic polyester, terephthalic polyester, orthophthalic polyester, dicyclopentadiene, urethane, silicone, polytetrafluoroethylene, polypropylene, polyethylene, polyamide, polyparabenzamide, silicone, viton, chloroprene, ethylene propylene terpolymer, isoprene, butyl, polystyrene or combinations or blends of the above.

A significant feature of this invention is to provide a stave cover for a stave of a material handling reel that is formed as a channel from a polymeric material wherein the stave cover has a flexible extension extending from both side walls of the channel and wherein the flexible extension has a strengthening material associated therewith.

A main purpose of this invention is to provide a stave cover for a stave of a material handling reel that is formed as a channel from a polymeric material wherein the stave cover has a flexible extension extending from both side walls of the channel and wherein the stave cover has a strengthening material incorporated into the flexible extension thereof. The strengthening material is preferably selected from the group consisting of natural fibers, synthetic fibers, metallic strands or combinations thereof.

A main purpose of this invention is to provide a stave cover for a stave of a material carrying reel, the stave cover formed as a channel from a polymeric material wherein the stave cover has a flexible extension extending from both side walls of the channel and wherein at least one extension is tapered from at least a side edge of the channel to an outboard edge thereof.

A primary principle of this invention is to provide a stave cover for a stave of a material carrying reel, the stave cover formed as a channel from a polymeric material wherein the stave cover has gripping members associated with an inside surface of the side edges of the channel wherein the gripping members frictionally engage side walls of a cross bar of the stave. The gripping members are preferably selected from the group consisting of inwardly turned square projections, barbs, rounded nubs, inwardly tapered projections or combinations thereof and may be disposed in rows and columns on the inside surface of at least one side edge of the channel.

A principal aim of this invention is to provide a material carrying reel and a stave cover, the material handling reel comprising a pair of spaced apart side flanges and a plurality of staves, the plurality of staves affixed to spokes of the side flanges, the plurality of staves comprising a core of the material carrying reel, at least one stave having a stave cover thereupon, the stave cover comprising an elongated channel having a flexible extension extending from at least one edge of a closed side of the channel, the flexible extension providing support to material on the material carrying reel.

Another significant feature of this invention is to provide a material carrying reel comprising a pair of side flanges, a plurality of staves and at least one stave cover wherein the staves are removably affixed to the spokes of the side flanges and wherein the stave cover is removably affixed to the stave.

Another main purpose of this invention is to provide a material carrying reel comprising a pair of side flanges, a plurality of staves and at least one stave cover wherein the staves comprise a cross bar and a pair of end members, the end members affixed to terminal ends of the cross bar, the end members comprising channels having one open side, the open sides of the channels of the end members received over the spokes of the side flanges. The end members have a through hole in at least one leg of the channel for receiving a fastener selected from the group consisting of bolts, screws, pins, rivets, snaps or combinations thereof therein and the spokes may have a plurality of holes disposed in at least one surface thereof, the fastener received in one hole of the plurality of holes. The staves are movable along the length of the spokes to provide for a plurality of core diameters for the material handling reel.

Yet another primary aspect of this invention is to provide a method of making a material handling reel comprises the steps of forming a pair of peripheral rings, butt welding ends of the peripheral rings thus forming a pair of rims, forming a plurality of spokes, forming a pair of hub plates, forming a hole through each hub plate, affixing the plurality of spokes to one hub plate, affixing a terminal end of the plurality of spokes to one rim thus constituting one side flange, affixing another plurality of spokes to another hub plate, affixing a terminal end of the plurality of spokes to another rim thus constituting another side flange, forming a plurality of cross bars, forming a plurality of end members, forming at least one fastening hole through at least one leg of each end member, affixing one end member to each end of each cross bar, thus constituting a plurality of staves, spacing the side flanges apart a distance substantially the same distance as the length of the cross bars, disposing one end member of one stave over one spoke of one side flange, disposing an opposed end member of one stave over one spoke of another side flange, affixing the end members to the spokes with fasteners and disposing and affixing additional staves to at least one other spoke of the side flanges.

DESCRIPTION OF THE PREFERRED EMBODIMENTS

While the various features of this invention are hereinafter described and illustrated as a replaceable stave cover for a stave of a material carrying reel and a material carrying reel having a plurality of stave covers on the staves thereof, it is to be understood that the various features of this invention can be used singly or in various combinations thereof a stave cover and a material handling reel as can hereinafter be appreciated from a reading of the following description.

Figure 1:
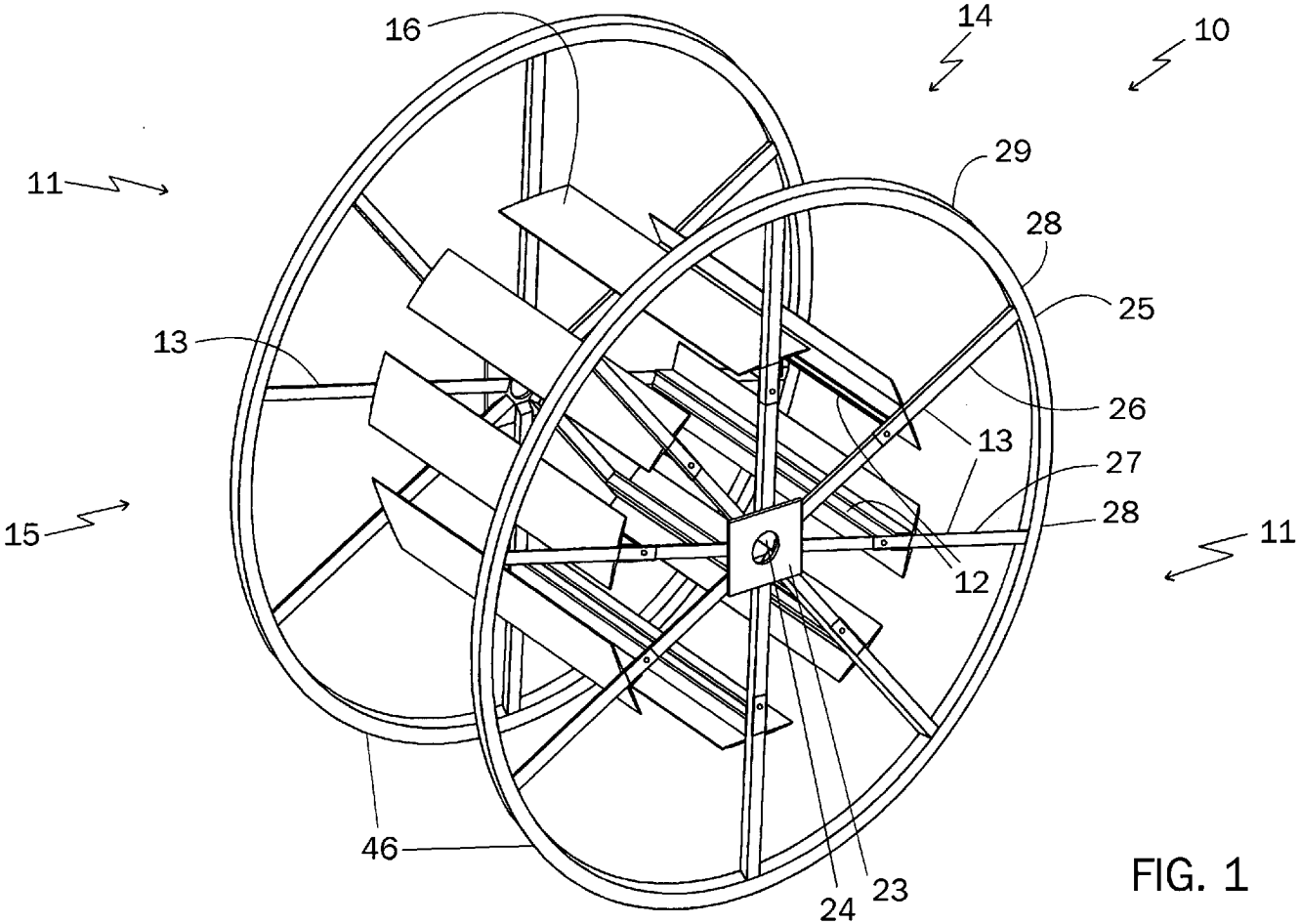
FIG. 1 is a perspective view of a material storage reel having stave covers of this invention removably affixed thereto.
Figure 2:
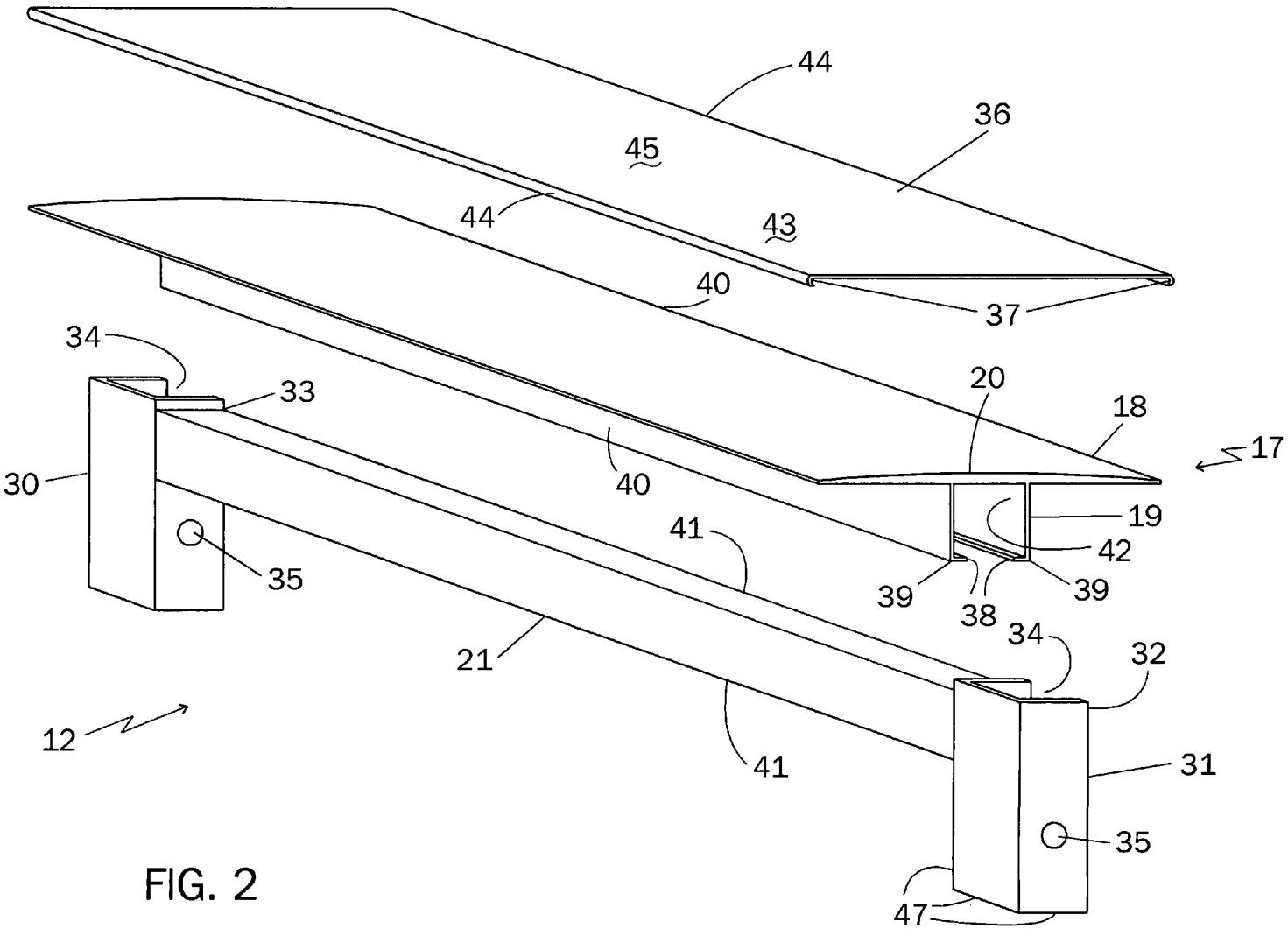
FIG. 2 is a perspective view of the preferred embodiment of the stave cover shown spaced from the cross bar of the stave.

Referring now to FIG. 1, a material carrying and handling reel, generally shown by the numeral 10, comprises a pair of spaced apart side flanges 11 and a plurality 14 of staves 12 affixed to spokes 13 of side flanges 11. Plurality 14 of staves 12 comprise a core 15 of material carrying reel 10. Referring also to FIG. 2, at least one stave 12 has a stave cover 16 thereupon, stave cover 16 comprising an elongated channel 17 having a firm but flexible extension 18 extending from at least one side leg 19 of a closed side 20 of elongated channel 17, flexible extension 18 providing support to material wound upon material carrying reel 10. Stave cover 16 is shown spaced from stave 12 in order to show the details of construction of stave cover 16 and the relationship of stave cover 16 with cross bar 21 of stave 12. Preferably, as shown in FIG. 2, stave cover 16 has flexible extension 18 extending from both side legs 19 thus constituting a circumferential support surface 22. Circumferential support surface 22 preferably extends the entire length of stave 12 between spokes 13 of side flanges 11 such that material handling reel 10 may be used for a variety of materials.

Still referring to FIGS. 1 and 2, side flanges 11 comprise a peripheral ring 29, a plurality of spokes 13 and a hub plate 23, spokes 13 preferably radiating from hub plate 23, hub plate 23 located at the center of peripheral ring 29, hub plate 23 having spokes 13 affixed thereto. Hub plate 23 has a spindle hole 24 disposed through the center thereof, spindle hole 24 accepting an axle which supports material handling reel 10 above a working surface such that material handling reel 10 may freely rotate as the outer peripheral surfaces 25 of peripheral rings 29 of side flanges 11 are raised above the working surface. Though hub plate 23 is shown disposed on only the outside surface 26 of spokes 13, it is fully within the scope of this invention to affix a second hub plate 23 on the inside surfaces 27 of spokes 13. The outward terminal ends 28 of spokes 13 are affixed to peripheral ring 29. Side flanges 11 are arranged in mirror image fashion and have staves 12 removably affixed to spokes 13, material handling reel 10 thus able to be disassembled, packaged flat with staves 12 arranged between the spokes 13 thereof and return shipped to a factory providing the material wound on material handling reel 10.

Staves 12 comprise cross bar 21 and end members 30, 31, end members 30, 31 preferably permanently affixed to the terminal ends 32, 33 of cross bar 21. A plurality 14 of staves 12 are placed between side flanges 11 with end members 30, 31 engaged with spokes 13 of opposed side flanges 11, staves 12 readily movable along the length of spokes 13 and removably affixed thereto to provide for a changeable diameter of core 15 for different materials or different amounts of material. In the preferred embodiment shown in FIG. 1, staves 12 are engaged with and removably affixed to each of the eight spokes 13, though it is within the scope of this invention to produce side flanges 11 with fewer or more spokes 13. Additionally, it is also within the scope of this invention to employ fewer staves 12 than spokes 13. Preferably, end members 30, 31 are channels with one open side 34, open side 34 received over spokes 13 of side flanges 11 and affixed thereto. Preferably end members 30, 31 have a through hole 35, through hole 35 receiving a fastener therein wherein the fastener engages spokes 13 of side flanges 11. The fastener may be selected from the group consisting of bolts, screws, pins, rivets, snaps or combinations thereof, however, it is also within the scope of this invention to permanently affix staves 12 to spokes 13, particularly where material handling reel 10 need not be transported over long distances.

Figure 3:
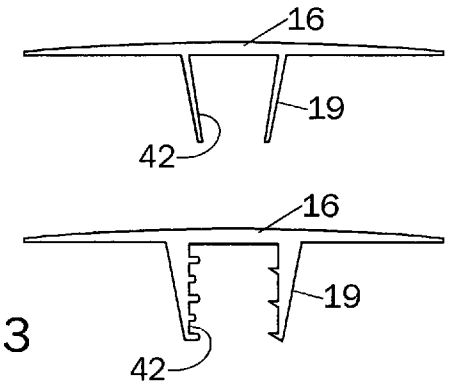
FIG. 3 shows end plan views of alternate configurations for gripping members for gripping the cross bar of the stave.

Stave cover 16 is preferably a unitary structure with flexible extensions 18 extending equally from both side legs 19 of elongated channel 17, flexible extensions 18 collinear with closed side 20 of elongated channel 17. As flexible extensions 18 are collinear with closed side 20, when assembled onto staves 12 of material handling reel 10, outboard edge 40 of flexible extensions 18 define chords of a circle in the area of flexible extensions 18 which provide support to material wound upon material handling reel 10 as will become readily apparent hereinafter. Stave cover 16 also preferably has gripping members 38 at the open ends 39 of side legs 19, gripping members 38 adapted to at least frictionally engage side walls 41 of cross bar 21 of stave 12. Gripping members 38 may be square and inwardly turned as shown in FIG. 2, but may also be barbed, rounded, inwardly tapered or a combination thereof as shown in FIG. 3. Continuing to refer to FIG. 3, additional gripping members 38 may also be provided on at least one inside surface 42 of side legs 19. For instance, a plurality of barbed ribs may be provided in parallel rows along the entire length of inside surface 42 of at least one side leg 19. Alternately, gripping members 38 may be arranged in rows and columns on at least one inside surface 42 of side legs 19 and may further be disposed on the entirety of inside surface 42 from open ends 39 to an inner surface of closed side 20. In yet another embodiment, side legs 19 may be tapered inwardly from closed side 20 of elongated channel 17 to open end 39 of side legs 19 instead of straight as shown in FIG. 1 and may additionally be provided with gripping members 38 as described above.

Figure 4:
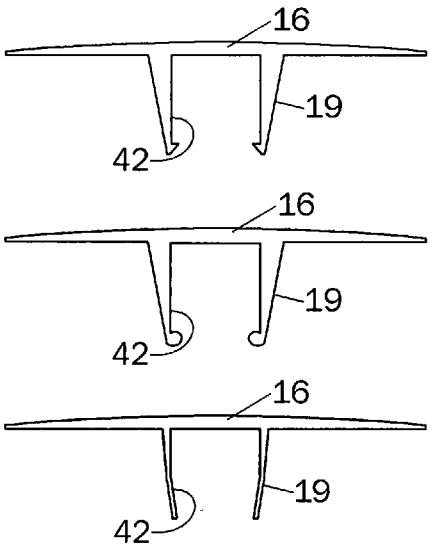
FIG. 4 is an end plan view of an alternate configuration for the stave cover of this invention for use with an angle iron stave cross bar.
Figure 4:
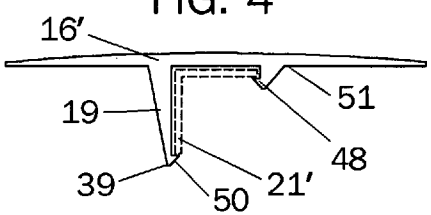

Referring now to FIG. 4, where stave cover 16' is used with an right angled cross bar 21' of stave 12, stave cover 16 has an internally facing lip 48 which locks stave cover 16 to right angled cross bar 21', cross bar 21' shown in dashed lines with stave cover 16' fitted thereto. Stave cover 16' preferably also has at least one gripping member 38 disposed on the downward side leg 19 of stave cover 16', a barb 50 shown on downward side leg 19 though other styles of gripping members may alternately be used. It is also within the scope of this invention to place inwardly facing lip 48 on open end 39 of downward leg 19 and employ a gripping member 38 on underside surface 51 of stave cover 16'.

Figure 5:
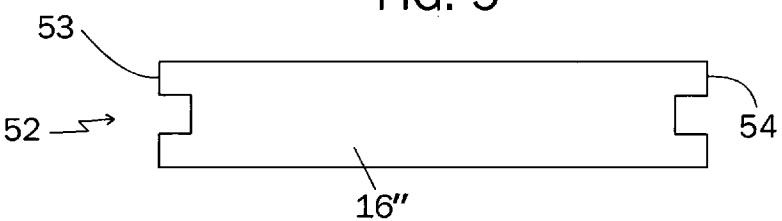
FIG. 5 is a top plan view of an alternate configuration for the stave cover of this invention for use with a curved cross section cross bar of the stave.

Referring now to FIG. 5, stave cover 16" is adapted for use with a curved cross section cross bar 21 of stave 12, stave cover 16" having a cutout 52 on at least one end 53, 54 thereof, cutout 52 adapted to engage a spoke 13 on at least one side flange 11. In this embodiment, stave cover 16" is longer than the distance between side flanges 11 as at least one end 53, 54 extends over at least a portion of spoke 13 of one side flange 11. Stave covers 16" may additionally have gripping members 38 disposed on inside surface 42 of at least one side leg 19 thereof.

Stave cover 16 is preferably made of polymeric material but could made from wood, wood byproducts, light weight metal, ivory, or combinations thereof. Outboard edges 40 of flexible extensions 18 preferably possess sufficient rigidity to support material wound upon material handling reel 10 while yielding slightly to provide for a rounded surface spanning from one outboard edge 40 to the opposed outboard edge 40. Thus, the chordal effect of stave covers 16 when first installed upon staves 12 serves to gently bend the material wound upon core 15 into a circular pattern as outboard flexible extensions 18 yield, therefore overcoming bending effects of the material when placed upon rigid boards fixed to prior art staves or upon the prior art staves themselves as is prevalent in the prior art. Since staves 12 may be moved along spokes 13, it is possible to provide for a substantially complete surface for core 15 when staves 12 are close enough to hub plates 23 that outboard edges 40 of adjacent stave covers 16 essentially touch.

Stave cover 16 may be formed from polymeric material selected from the group consisting of ABS, acrylates, acetals, acrylic, amides, amide-imides, chloroprene, ethylene propylene polymer, dicyclopentadiene, epoxy, fiberglass, methyl methacrylate, parabenzamides, polyethylenes, isophthalic polyester, terephthalic polyester, orthophthalic polyester, propylenes, polyurethane, styrenes, tetrafluoroethylenes, vinyls, vinylchlorides, carbonates, polycarbonate, polypropylene, polyethylene, polyvinyl chloride, polyamide, polyparabenzamide, polystyrene, silicone, viton, isoprene, butyl, polystyrene vinyl ester, or combinations or blends of the above, however, other materials may also be utilized, such as UHMW solid material, Type I, II, III or IV engineered food grade thermoplastics but most preferably is made from an amide, commonly known as nylon. Stave covers 16 are preferably formed by extrusion, however it is within the scope of this invention to form stave covers 16 by injection molding, transfer molding, compression molding or combinations thereof or stave covers 16 may be machined from bar stock of the selected material.

Stave cover 16 may have strengthening material associated therewith, the strengthening materials preferably confined within the bounds of flexible extensions 18 to impart greater support at outboard edges 40 of flexible extensions 18. Strengthening materials incorporated into flexible extensions 18 may be selected from the group comprising organic fillers, inorganic fillers, natural or synthetic fibers, metallic strands, mesh or combinations thereof. Incorporation of these materials into polymers is well known in the art and need not be fully described herein. In the preferred embodiment, stave cover 16 contains aramid, fiberglass or carbon fibers incorporated into an amide polymer.

In an alternate embodiment, strengthening materials may also comprise a flexible clip 36 as shown above stave cover 16 in FIG. 2, flexible clip 36 engaging both outboard side edges 40 of flexible extensions 18 thus imparting additional strength thereto. Flexible clip 36 is preferably made of a thin gauge stainless spring steel but may also be polymeric. The inwardly turned ends 37 of flexible clip 36 snap fit over outboard side edges 40 of stave cover 16 providing both a rounded surface to outboard side edges 40 and a smooth top surface 43 for receiving material thereupon. Additionally, it is possible to make flexible clip 36 sufficiently wide between inwardly turned ends 37 to span across stave covers 16 disposed on adjacent staves 12 to lengthen top surface 43. Downward pressure on edges 44 of flexible clip 36 due to the winding of material around core 15 will tend to bow up a central portion 45 of top surface 43 thus providing even more support to the material.

As stave covers 16 are friction fitted to cross bar 21 of stave 12, stave covers 16 are removable and replaceable. It should be readily apparent that by spreading side legs 19 and lifting end 53 or 54 of stave cover 16, stave cover 16 may be removed from cross bar 21.

A method of making material handling reel 10 comprises the steps of forming a pair of peripheral rings 29 from channel, angle, rectangular or curved cross section tubing, but most preferably from 1¼ inch by 1½ inch rectangular tubing with ends of peripheral rings 29 butt welded into a pair of substantially circular rims 46. A plurality of spokes 13 are then formed from channel, angle, rectangular or curved cross section tubing, most preferably 1¼ inch by 1½ inch rectangular tubing, the length of each spoke 13 slightly less than one half the inside diameter of circular rims 46. Hub plates 23 are preferably formed from three-eighths thick steel plate about 8 inches square, each hub plate 23 having a spindle hole 24 disposed therethrough. The plurality of spokes 13 are equally spaced around each hub plate 23 and affixed thereto preferably by welding, however it is within the scope of this invention to affix spokes 13 to hub plates 23 in any suitable manner. Preferably, eight spokes 13 are affixed to each hub plate 23 with terminal ends 28 of each spoke 13 substantially at a radius equal to one half the inside diameter of circular rims 46. Terminal ends 28 of each of the plurality of spokes 13 that are affixed to one hub plate 23 are then affixed to one rim 46 thus constituting one side flange 11. Another side flange 11 is prepared in the same manner. Preferably, a circular rim 46, eight spokes 13 and one hub plate 23 are placed in a jig such that all these components are properly placed and thus may be fixed in substantially perfect alignment such that when finished, side flanges 11 are substantially perfectly circular. Cross bars 21 are then formed from channel, angle, rectangular or curved cross section tubing, most preferably from 1¼ inch by 1½ inch rectangular tubing, to a length substantially equal to the inside width of material handling reel 10, it being fully understood that material handling reels 10 are used for storing, transporting and dispensing a plurality of materials and thus the width of material handling reel 10 and the diameter of core 15 is made to specification. End members 30, 31 are formed from channel, angle, rectangular or curved cross section tubing, most preferably from 1¼ inch channel, each end member 30, 31 having at least one through hole 35 formed through at least one leg 47, through hole 35 adapted to receive a fastener therein to affix end members 30, 31 to spokes 13. One end member 30 is then affixed to one terminal end 32 of each cross bar 21, and other end member 31 is affixed to the other terminal end 33 of each cross bar 21, open side 34 of end members 30, 31 preferably facing the same direction, the joinder of end members 30, 31 to cross bars 21 thus constituting a plurality 14 of staves 12. Material handling reel 10 is then formed by spacing two side flanges 11 apart a distance substantially the same distance as the length of cross bars 21, disposing one end member 30 of one stave 12 over one spoke 13 of one side flange 11, disposing an opposed end member 31 of the one stave 12 over one spoke 13 of the other side flange 11 and affixing end members 30, 31 to spokes 13 with fasteners through holes 35 in end members 30, 31. Additional staves 12 are then assembled in like manner to at least one other spoke 13 of side flanges 11 and preferably to all eight spokes 13. Stave covers 16 are then aligned with the outwardly facing side wall 41 of each stave 12, stave covers 16 snap fitted over parallel side walls 41 adjacent the outwardly facing side wall 41. Gripping members 38 preferably engage at least one of parallel side walls 41 and may extend below the bottom of side wall 41 opposite outwardly facing side wall 41 of stave 12 thus clipping against the bottom of side walls 41. In the preferred embodiment, side flanges 11 and staves 12 are preferably steel, however, it is within the scope of this invention to use alternate materials having sufficient strength and formability for these components.

While the present invention has been described with reference to the above described preferred embodiments and alternate embodiments, it should be noted that various other embodiments and modifications may be made without departing from the spirit of the invention. Therefore, the embodiments described herein and the drawings appended hereto are merely illustrative of the features of the invention and should not be construed to be the only variants thereof nor limited thereto.

I claim:

1. A material carrying reel comprises a pair of spaced apart side flanges, a plurality of staves and at least one stave cover, said plurality of staves removably affixed to spokes of said side flanges, said plurality of staves comprising a core of said material carrying reel, said at least one stave having said stave cover thereupon, said stave cover comprising an elongated channel having a flexible extension extending from at least one edge of a closed side of said channel, said flexible extension providing support to material on said material carrying reel.

2. A material carrying reel as in claim 1 wherein said flexible extension extends from both side edges of said closed side of said channel.

3. A material carrying reel as in claim 1 wherein said stave cover is formed from a material selected from the group consisting polymeric material, wood, wood byproducts, light weight metal, ivory, or combinations thereof.

4. A material carrying reel as in claim 3 wherein said stave cover is formed by extrusion, injection molding, transfer molding, compression molding, machined from bar stock or combinations thereof.

5. A material carrying reel as in claim 4 wherein said stave cover is formed from a polymeric material selected from the group consisting of ABS, acrylates, acetals, acrylic, amides, amide-imides, chloroprene, ethylene propylene polymer, dicyclopentadiene, epoxy, fiberglass, methyl methacrylate, parabenzamides, polyethylenes, isophthalic polyester, terephthalic polyester, orthophthalic polyester, propylenes, polyurethane, styrenes, tetrafluoroethylenes, vinyls, vinylchlorides, carbonates, polycarbonate, polypropylene, polyethylene, polyvinyl chloride, polyamide, polyparabenzamide, polystyrene, silicone, viton, isoprene, butyl, polystyrene vinyl ester, or combinations or blends of the above.

6. A material carrying reel as in claim 5 wherein said flexible extension has a strengthening material associated therewith.

7. A material carrying reel as in claim 6 wherein said strengthening material is incorporated into said flexible extension.

8. A material carrying reel as in claim 7 wherein said strengthening material is selected from the group consisting of natural fibers, synthetic fibers, metallic strands or combinations thereof.

9. A material carrying reel as in claim 1 wherein said one extension is tapered from at least said side edge of said channel to an outboard edge thereof.

10. A material carrying reel as in claim 1 wherein said channel has gripping members associated with an inside surface of said side edges wherein said gripping members frictionally engage side walls of a cross bar of said stave.

11. A material carrying reel as in claim 10 wherein said gripping members are selected from the group consisting of inwardly turned square projections, barbs, rounded nubs, inwardly tapered projections or combinations thereof.

12. A material carrying reel as in claim 11 wherein said gripping members are disposed in rows and columns on said inside surface of at least one side edge of said channel.

13. In combination, material carrying reel and a stave cover, said material handling reel comprising a pair of spaced apart side flanges and a plurality of staves, said plurality of staves affixed to spokes of said side flanges, said plurality of staves comprising a core of said material carrying reel, at least one said stave having said stave cover thereupon, said stave cover comprising an elongated channel having a flexible extension extending from at least one edge of a closed side of said channel, said flexible extension providing support to material on said material carrying reel.

14. A combination as in claim 13 wherein said staves are removably affixed to said spokes.

15. A combination as in claim 14 wherein said plurality of staves comprise a cross bar and a pair of end members, said end members affixed to terminal ends of said cross bar, said end members comprising channels having one open side, said open sides of said channels of said end members received over said spokes of said flanges.

16. A combination as in claim 15 wherein said end members have a through hole in at least one leg of said channel for receiving a fastener therein.

17. A combination as in claim 16 wherein said spokes have a plurality of holes disposed in at least one surface thereof, said fastener received in one hole of said plurality of holes.

18. A combination as in claim 17 wherein said staves are movable along the length of said spokes to provide for a plurality of core diameters for said material handling reel.

19. A combination as in claim 18 wherein said fastener is selected from the group consisting of bolts, screws, pins, rivets, snaps or combinations thereof.

20. A method of making a material handling reel comprises the steps of forming a pair of peripheral rings, butt welding ends of said peripheral rings thus forming a pair of rims, forming a plurality of spokes, forming a pair of hub plates, forming a hole through each said hub plate, affixing said plurality of spokes to one said hub plate, affixing a terminal end of said plurality of spokes to one said rim thus constituting one side flange, affixing said plurality of spokes to another said hub plate, affixing a terminal end of said plurality of spokes to said another rim thus constituting another side flange, forming a plurality of cross bars, forming a plurality of end members, forming at least one fastening hole through at least one leg of each said end member, affixing one said end member to each end of each said cross bar, thus constituting a plurality of staves, spacing said side flanges apart a distance substantially the same distance as the length of said cross bars, disposing one said end member of one said stave over one spoke of said one side flange, disposing an opposed end member of said one stave over one spoke of said another side flange, affixing said end members to said spokes with fasteners, disposing and affixing additional said staves to at least one other spoke of said side flanges, forming a stave cover as a channel with extensions extending from both side walls of said channel, said extensions collinear with a closed side wall of said channel and removably affixing at least one said stave cover to at least one said stave.

* * * * *